US010321708B2

(12) United States Patent
Marshall et al.

(10) Patent No.: US 10,321,708 B2
(45) **Date of Patent: *Jun. 18, 2019**

(54) TREATMENT OF TOBACCO

(71) Applicant: R.J. Reynolds Tobacco Company, Winston-Salem, NC (US)

(72) Inventors: Jerry Wayne Marshall, Stokesdale, NC (US); Anthony Richard Gerardi, Winston-Salem, NC (US); Luis Monsalud, Jr., Kernersville, NC (US); Alton Busbee, Lexington, NC (US); Jo Ann Hill Hart, Winston-Salem, NC (US); Annett Milling, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/902,397

(22) Filed: Feb. 22, 2018

(65) Prior Publication Data

US 2018/0177224 A1 Jun. 28, 2018

Related U.S. Application Data

(63) Continuation of application No. 14/712,360, filed on May 14, 2015, now Pat. No. 9,918,492.

(51) Int. Cl.

| | |
|---|---|
| ***A24B 15/28*** | (2006.01) |
| ***A24B 13/00*** | (2006.01) |
| ***A24B 15/20*** | (2006.01) |
| ***A24B 15/24*** | (2006.01) |
| ***A24B 15/30*** | (2006.01) |
| ***A24B 15/42*** | (2006.01) |

(52) U.S. Cl.

CPC ..... *A24B 15/28* (2013.01); *A24B 13/00* (2013.01); *A24B 15/20* (2013.01); *A24B 15/245* (2013.01); *A24B 15/287* (2013.01); *A24B 15/30* (2013.01); *A24B 15/307* (2013.01); *A24B 15/42* (2013.01)

(58) Field of Classification Search

CPC ..... A24B 15/28; A24B 15/20; A24B 15/245; A24B 15/287; A24B 15/30; A24B 15/307; A24B 15/42; A24B 13/00

See application file for complete search history.

(56) References Cited

U.S. PATENT DOCUMENTS

| | | | |
|---|---|---|---|
| 4,528,993 | A | 7/1985 | Sensabaugh, Jr. et al. |
| 4,607,479 | A | 8/1986 | Linden |
| 4,631,899 | A | 12/1986 | Nielsen |
| 4,660,577 | A | 4/1987 | Sensabaugh et al. |
| 5,346,734 | A | 9/1994 | Wydick, Jr. et al. |
| 5,372,149 | A | 12/1994 | Roth et al. |
| 6,162,516 | A | 12/2000 | Derr |
| 6,755,200 | B1 | 6/2004 | Hempfling et al. |
| 7,549,425 | B2 | 6/2009 | Koga et al. |
| 7,946,295 | B2 | 5/2011 | Brinkley et al. |
| 8,061,362 | B2 | 11/2011 | Mua et al. |
| 8,353,300 | B2 | 1/2013 | Li et al. |
| 8,905,041 | B2 | 12/2014 | Li et al. |
| 9,918,492 | B2 * | 3/2018 | Marshall ..... A24B 15/28 |
| 2004/0118422 | A1 | 6/2004 | Lundin et al. |
| 2005/0061339 | A1 | 3/2005 | Hansson et al. |
| 2005/0115576 | A1 | 6/2005 | Koga et al. |
| 2007/0062549 | A1 | 3/2007 | Holton, Jr. et al. |
| 2007/0186941 | A1 | 8/2007 | Holton, Jr. et al. |
| 2008/0029110 | A1 | 2/2008 | Dube et al. |
| 2008/0202538 | A1 | 8/2008 | Li et al. |
| 2010/0018539 | A1 | 1/2010 | Brinkley et al. |
| 2012/0272976 | A1 | 11/2012 | Byrd et al. |
| 2012/0279510 | A1 | 11/2012 | Marshall et al. |

(Continued)

FOREIGN PATENT DOCUMENTS

| | | |
|---|---|---|
| CN | 101416778 | 4/2009 |
| DE | 29 27 188 | 1/1981 |

(Continued)

OTHER PUBLICATIONS

Fisher et al., "Sources of and Technical Approaches for the Abatement of Tobacco Specific Nitrosamine Formation in Moist Smokeless Tobacco Products," *Food and Chemical Toxicology*, 50(3-4), 2012, pp. 942-948.

Giacomo et al., "Microbial Community Structure and Dynamics of Dark Fire-Cured Tobacco Fermentation," *Applied and Environmental Microbiology*, 2007, vol. 73, No. 3, pp. 825-837.

Gilliland, Ed., Bacterial Starter Cultures for Foods, CRC Press, Inc. (Boca Raton, FL), p. 97-118; "The Lactobacilli, Pediococci, and Leuconostocs: Vegetable Products," *Paper No. 9197 of the Journal Series of the North Carolina Agricultural Research Service*, Oct. 24, 1985.

(Continued)

*Primary Examiner* — Anthony Calandra
*Assistant Examiner* — Jamel M Nelson
(74) *Attorney, Agent, or Firm* — Womble Bond Dickinson (US) LLP

(57) ABSTRACT

Methods of modifying the tobacco-specific nitrosamine content of a tobacco material are described herein. One exemplary method comprises contacting a tobacco material with a composition comprising salt, sugar, enzyme, lactic acid bacteria, yeast, or a combination thereof to reduce the total bacterial content; curing the tobacco material; and fermenting the tobacco material in the presence of one or more microorganisms. The method can provide a fermented tobacco material having a tobacco-specific nitrosamine content that is reduced relative to a fermented tobacco material that has not been subjected to the disclosed method steps. In certain embodiments, the tobacco-specific nitrosamine content of the fermented tobacco material is no more than that of the cured tobacco material. Tobacco-containing products including such treated tobacco materials are also provided.

18 Claims, No Drawings

(56) References Cited

U.S. PATENT DOCUMENTS

| | | | |
|---|---|---|---|
| 2013/0269719 | A1 | 10/2013 | Marshall et al. |
| 2014/0020694 | A1 | 1/2014 | Moldoveanu et al. |
| 2014/0261478 | A1 | 9/2014 | Xu et al. |
| 2014/0261481 | A1 | 9/2014 | Warek et al. |
| 2014/0299136 | A1 | 10/2014 | Moldoveanu et al. |

FOREIGN PATENT DOCUMENTS

| | | |
|---|---|---|
| WO | WO 2003/094639 | 11/2003 |
| WO | WO 2006/034554 | 4/2006 |

OTHER PUBLICATIONS

Gürtler et al., "Physiological Diversity Among Strains of Tetragenococcus Halophilus," *Systematic and Applied Microbiology*, 21, 107-112 (1998).

Larsson et al., "Identification of Bacterial and Fungal Components in Tobacco and Tobacco Smoke," *Tobacco Induced Diseases*, 2008, 4:4, 8 pages. http://tobaccoinduceddiseases.biomedcentral.com/articles/10.1186/1617-9625-4-4.

Nishimura, "Clinical Efficacy of halophilic Lactic Acid Bacterium Tetragenococcus Halophilus," *Allergology International*, 2005, 58:179-185, accessed at http://www.sciencedirect.com/ on Jun. 21, 2017.

Sapkota et al., Research Project 3: Exploring Tobacco Microbial Constituents and the Oral Microbiome of Tobacco Users, *University of Maryland/Batelle Tobacco Center of Regulatory Science*, https://tcors.umd.edu/project/research-project-3-exploring-tobacco-microbial-constituents-and-oral-microbiome-tobacco , Accessed Mar. 6, 2015.

Song et al., "Nitrite Reductase Genes in Halobenzoate Degrading Denitrifying Bacteria," *FEMS Microbiology Ecology*, 2003, vol. 43, pp. 349-357.

Takahashi et al., "Nitrite Reductase Gene Enrichment Improves Assimilation of $NO_2$ *Arabidopsis*[1]," *Plant Physiology*, 2001, vol. 126 No. 2, pp. 731-741.

Teague, "Nitrate Reduction and NOx Formation by Copenhagen Bacteria," http://industrydocuments.library.ucsf.edu/tobacco/docs/gjwf0044, 1982, 2 pages.

Vigliotta et al., "Nitrate Metabolism in *Debaryomyces* hansenii TOB-Y7, a Yeast Strain Involved in Tobacco Fermentation," *Applied Microbial and Cell Physiology*, 2007, 75:633-645.

Yoshie et al., "Salinity Decreases Nitrate Reductase Gene Diversity in Denitrifying Bacteria of Wastewater Treatment Systems," *Applied and Environmental Microbiology*, 70(5):3152-3157 (2004).

* cited by examiner

TREATMENT OF TOBACCO

FIELD OF THE INVENTION

The present invention relates to modifications to methods of growing and harvesting plants (such as tobacco), to methods of handling and treating harvested plants and plant materials for use in the preparation of plant-derived products (such as tobacco products); and particularly to those methods related to processed tobaccos that are considered to be subjected to so-called fermentation processing conditions. More particularly, the present invention relates to technologies associated with the manufacturing of products made or derived from tobacco, or that otherwise incorporate tobacco or components of tobacco, and are intended for human consumption.

BACKGROUND OF THE INVENTION

Many uses of tobacco have been proposed. For example, tobacco has been smoked in pipes, and tobacco also has incorporated into tobacco burning smoking articles, such as cigarettes and cigars. See, for example, *Tobacco Production, Chemistry and Technology*, Davis et al. (Eds.) (1999), which is incorporated herein by reference. There also have been proposed various ways of providing many of the sensations of smoking, but without delivering considerable quantities of incomplete combustion and pyrolysis products that result from burning tobacco. See, for example, the background art set forth in U.S. Pat. Nos. 7,753,056 to Borschke et al. and 7,726,320 to Robinson et al.; US Pat. Pub. Nos. 2014/0060555 to Chang et al. and 2014/0270730 to DePiano et al.; and U.S. patent application Ser. No. 14/098,137, filed Dec. 6, 2013 to Ademe et al.; which are incorporated herein by reference. Tobacco also has been enjoyed in a so-called "smokeless" form. See, for example, the background art set forth in US Pat. Pub. Nos. 2014/0271952 to Mua et al. and 2012/0272976 to Byrd et al., which are incorporated herein by reference.

Through the years, various treatment methods and additives have been proposed for altering the overall character or nature of tobacco materials utilized in tobacco products. For example, tobacco materials have been treated with additives, and treatment conditions used during the processing of those tobacco materials have been controlled, in order to alter the chemistry or sensory properties of smokeless tobacco products produced from such tobacco materials, and, in the case of smokable tobacco materials, to alter the chemistry or sensory properties of mainstream smoke generated by smoking articles incorporating such tobacco materials. See, for example, the types of enzymes and microorganisms (e.g., bacteria, fungi and yeast) employed and/or controlled during tobacco processing for the purpose of altering the chemical makeup of that tobacco set forth in US Pat. Pub. No. 2014/0299136 to Moldoveanu et al., which is incorporated herein by reference.

It would be desirable to provide further methods for altering the character and nature of components of a plant, in order to provide plant-based compositions and formulations useful for human consumption. In particular, it would be desirable to provide processed tobaccos, and particularly processed tobaccos useful for the production of smokeless tobacco products, that result from processes that have the ability to control or alter the chemical composition of those processed tobaccos.

SUMMARY OF THE INVENTION

The present disclosure provides a method of treating a plant or a portion thereof to modify (e.g., increase and/or decrease) the amount of certain bacteria present therein. Particularly, the disclosed methods can be applied to tobacco plants and materials and can, in some embodiments, result in a decrease in total bacterial content associated with the tobacco plant or material and/or an increase in *Lactobacillus* bacterial content associated with the tobacco plant or material.

In some embodiments, the present invention provides plants, plant components, and plant materials having modified levels of certain bacteria, as well as methods of treating uncured or partially cured (e.g., green) plants, plant components, and plant materials to provide such modified bacteria levels. In some embodiments, the invention provides fermented plants, plant components, and plant materials having modified levels of various compounds (e.g., tobacco-specific nitrosamines, TSNAs). The invention also provides methods of fermenting plants, plant components, and plant materials to achieve such modified levels of various compounds. For example, in some embodiments, plants, plant components, and plant materials are subjected to fermentation in the presence of one or more microorganisms in exogenous amounts to obtain such modified levels of various compounds in the treated tobacco material.

In one aspect of the invention is provided a method of modifying the tobacco-specific nitrosamine content of a tobacco material, comprising: contacting a tobacco material (e.g., including, but not limited to, an unharvested tobacco material) with a treatment composition, wherein the treatment composition comprises a salt, a sugar, an enzyme, a lactic acid bacteria, a yeast, or a combination of two or more of these, wherein said contacting provides a treated tobacco material having a reduced total bacterial content following harvest; curing the treated tobacco material to give a cured tobacco material; and fermenting the cured tobacco material in the presence of one or more microorganisms, wherein the one or more microorganisms are present in exogenous amounts to the cured tobacco material to provide a fermented tobacco material having a tobacco-specific nitrosamine content that is reduced relative to a fermented tobacco material that has not been contacted with a treatment composition and has not been fermented in the presence of said microorganisms.

The tobacco material subjected to such treatment can vary and, in some embodiments, can be selected from the group consisting of a tobacco seed, a tobacco seedling, an immature live plant, a mature live plant, or a portion thereof. The specific tobacco material can, in some embodiments, comprise tobacco selected from the group consisting of Black Mammoth, Greenwood, Little Wood, Improved Madole, TR Madole, Little Crittendon, DF 911, KY 160, KY 171, KY 180, KY 190, KY 309, KY VA 312, VA 355, VA 359, DF 485, TN D94, TN D950, and combinations thereof. The treatment composition can, in some embodiments, comprise a chloride-containing salt (e.g., NaCl or KCl).

The microorganisms employed in the methods disclosed herein can, some embodiments, be microorganisms that do not facilitate conversion of nitrate to nitrite. In certain embodiments, the microorganisms are capable of growth competition with one or more nitrate-reducing microorganisms that are native to the tobacco. In some embodiments, the microorganisms are nitrite sinks. Certain exemplary microorganisms comprise nitrite reductase genes. The microorganisms can be, for example, bacteria (e.g., lactic acid bacteria) and/or salt-tolerant yeasts. One specific microorganism that can be employed in some embodiments is *Tetragenococcus halophilus*. In certain embodiments, the one or more microorganisms employed in the methods disclosed herein can comprise genetically modified microorganisms (e.g., bacteria). For example, in some embodiments, such microorganisms (including, but not limited to, *Tetragenococcus* bacteria) can comprise inserted genes encoding for nitrite reductase.

Following certain methods disclosed herein, the tobacco-specific nitrosamine (TSNA) content in the fermented tobacco material may be reduced by varying levels with respect to a fermented tobacco material that has not been contacted with a treatment composition and has not been fermented in the presence of said microorganisms. For example, the TSNA content can be reduced by about 10% or more, about 20% or more, or about 50% or more. In some embodiments, the TSNA content of the fermented tobacco material is no more than the TSNA content of the cured tobacco material. In certain embodiments, e.g., due to use of a salt treatment pre-harvest, the chloride content of the fermented tobacco material may be elevated as compared with a non-treated tobacco material. For example, in some embodiments, the chloride content of the fermented tobacco material provided according to the methods disclosed herein is between about 0.5% by dry weight and about 3% by dry weight.

In some embodiments, in addition to the method steps noted above, the method can further comprise: processing the fermented tobacco material to provide a processed tobacco material in a form suitable for incorporation in a tobacco product; and incorporating the processed tobacco material into a smokeless tobacco product. The processed tobacco material can be, for example, in the form of a tobacco blend. The present disclosure also provides, in certain embodiments, a smokeless tobacco product prepared according to the methods disclosed herein.

In another aspect, the invention provides a method of modifying the tobacco-specific nitrosamine content of a tobacco material, comprising: conditioning a harvested tobacco material to a desired moisture level; separating the stem from the harvested tobacco material to give a destemmed tobacco material; cutting the destemmed tobacco material to provide cut, destemmed tobacco material; contacting the cut, destemmed tobacco material with salt and heating the resulting mixture; fermenting the mixture in the presence of one or more microorganisms, wherein the one or more microorganisms are present in exogenous amounts to the mixture to provide a fermented tobacco material having a tobacco-specific nitrosamine content that is reduced relative to a fermented tobacco material that has not been contacted with salt prior to fermenting and has not been fermented in the presence of said microorganisms. In certain preferred embodiments, the tobacco-specific nitrosamine content of the fermented tobacco material in such embodiments is no more than the tobacco-specific nitrosamine content of the tobacco material just prior to fermentation (i.e., the cut, destemmed tobacco material).

The contacting step can, in some embodiments, further comprise pasteurizing the mixture. In some embodiments, the conditioning step comprises conditioning the tobacco material to a moisture level of about 20% to about 25%. In certain embodiments, the contacting and fermenting steps are conducted in a solid state fermentation vessel. The fermenting step can, in some embodiments, further comprise controlling the temperature, moisture, oxygen level, or any combination thereof. The one or more microorganisms used in such a method can, in certain embodiments, comprise *Tetragenococcus halophilus* in varying amounts (e.g., including, but not limited to, about $10^6$ CFU).

In certain embodiments, the method can further comprise subjecting fermented tobacco material to elevated temperature. The method can, in some embodiments, further comprise adding one or more components to the fermented tobacco material, wherein the one or more components comprise components selected from the group consisting of salt, preservatives, casing mixtures, and moisture. In certain embodiments, the method can further comprise adjusting the moisture level of the fermented tobacco material.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Exemplary plants that are grown, harvested, and/or processed in accordance with the present invention are selected from the *Nicotiana* species. The selection of the plant from the *Nicotiana* species can vary, and is more preferably a plant that is characterized as being a type of tobacco. See, for example, the types of plants set forth in U.S. Pat. Nos. 7,025,066 to Lawson et al. and 8,186,360 to Marshall et al.; and US Pat. Pub. Nos. 2014/0271951 to Mua et al. and 2015/0034109 to Dube et al., which are incorporated herein by reference. Preferred exemplary types of tobaccos that can be processed and used in accordance with the present invention include those known as Black Mammoth, Greenwood, Little Wood, Improved Madole, TR Madole, Little Crittendon, DF 911, KY 160, KY 171, KY 180, KY 190, KY 309, KY VA 312, VA 355, VA 359, DF 485, TN D94, TN D950. Also preferred are those exemplary types of tobaccos that are grown in the so-called Green River and One Sucker growing regions.

In certain embodiments, plants can be treated with a treatment composition, as will be disclosed herein, when the plants are in unharvested form and/or through the yellowing/browning stage of curing (i.e., before the tobacco is completely cured). This period of time will be referred to herein generally as "pre-cure," and the tobacco treated with such a treatment composition will be referred to herein generally as "uncured or partially cured" tobacco. A first pre-cure treatment method disclosed herein generally comprises treating such tobacco by contacting the tobacco with one or more of: a salt and/or sugar-containing composition; a lactic acid bacteria-containing composition; and/or an enzyme-containing composition (collectively referred to herein as "treatment compositions"), for example, using the types of treatment compositions and methods set forth in US Pat. App. Publ. No. 2014/0299136 to Moldoveanu et al., which is incorporated herein by reference.

In certain embodiment, the treatment composition comprises salt (e.g., in the form of a salt-containing solution). Salt treatment of various types of plants is known, for example, as described in U.S. Pat. Nos. 8,353,300 and 8,905,041 to Li et al. and 6,755,200 to Hempffing et al. and US Pat. Appl. Publ. Nos. 2008/0202538 to Li et al. and 2012/0279510 to Marshall et al., which are all incorporated herein by reference. Any salt can be used for this purpose, although food-grade salts are especially preferred. Exemplary salts include, but are not limited to, chloride-containing salts such as sodium chloride (NaCl), calcium chloride ($CaCl_2$), magnesium chloride ($MgCl_2$), potassium chloride (KCl), ammonium chloride, and combinations thereof. Accordingly, in some embodiments, the treatment composition comprises chlorine or chloride. It is noted that, traditionally, chloride (including chloride-containing salt) treatment of tobacco has been avoided, as it has been noted to negatively affect the taste of smoking products into which the treated tobacco is incorporated. However, in certain embodiments, for various applications (including, but not limited to, use in smokeless tobacco products and in electronic cigarette-type products), the presence of chloride is not as undesirable. In fact, in some embodiments, the presence of chloride may provide beneficial effects, including, but not limited to, reduction of TSNA concentration in the treated plants as compared with untreated plants, following curing and subsequent fermentation. Further details on certain types of salt compositions that can be employed in this context are provided, for example, at US Pat. App. Publ. No. 2014/0299136 to Moldoveanu et al., which is incorporated herein by reference. In certain embodiments, the treatment composition comprises sugar (e.g., in the form of a sugar-containing solution). Any sugar, including food-grade sugars, can be used for this purpose, e.g., including but not limited to, sucrose, glucose, fructose, galactose, maltose, and lactose, rhamnose, xylose, and combinations thereof. Further details on certain types of sugar solutions that can be employed in this context are provided, for example, at US Pat. App. Publ. No. 2014/0299136 to Moldoveanu et al., which is incorporated herein by reference. In some embodiments, a treatment composition can comprise both salt and sugar.

In some embodiments, the treatment composition comprises one or more probiotics or one or more lactic acid bacteria. Such compositions can be prepared and used, for example, as described in US Pat. Appl. Pub. Nos. 2013/0269719 to Marshall et al. and 2014/0299136 to Moldoveanu et al., which are incorporated herein by reference. Identification of the types of bacteria that can be useful in such treatments, specific bacteria used, amounts of bacteria used, and specific properties provided by such bacteria are further set forth in these references. In some embodiments, the treatment composition comprises one or more enzymes. Such compositions can be prepared and used, for example, as described in US Pat. Appl. Pub. Nos. 2014/0020694 and 2014/0299136, both to Moldoveanu et al., which are incorporated herein by reference. Identification of the types of enzymes that can be useful in such treatments, specific enzymes used, amounts of enzyme used, and specific properties provided by such enzymes are further set forth in these references.

In certain embodiments, the treatment composition comprises one or more species of yeasts. Although not intended to be limiting, one exemplary yeast is a *Debaryomyces hansenii* yeast with nitrite reductase capability. In preferred embodiments, one or more salt-tolerant yeasts are employed, alone or in combination with one of the other treatment compositions disclosed herein.

The pre-cure treatment compositions can take various forms. For example, in some embodiments, the treatment composition can be in liquid form (e.g., a solution, dispersion, emulsion, or the like, referred to herein as a "treatment solution"). The concentrations (e.g., solids contents) of such treatment solutions can vary. In some embodiments, the treatment composition can be in solid form (e.g., powder or granular form). The compositions can, in some embodiments, comprise various other components.

The pure-cure treatment compositions described can be applied in various ways and at various times. Generally, the treatment compositions can be applied topically to the plant (e.g., such that one or more components of the compositions are supplied to the plant through the leaf, stem, flower, etc.) or can be applied such that one or more components are supplied to the plant through the root system. Liquid forms can be applied, e.g., by spraying, misting, or dipping the plant or portion thereof to be treated (e.g., foliar application) or the soil surrounding the plant (soil application). Solid forms of the treatment compositions can be directly applied to a plant or portion thereof or can be applied to the soil surrounding the plant (e.g., sprinkled on the soil surface and/or worked into the soil, such as in the form of a "side dressing"). In certain embodiments, the treatment composition can be applied in the form of a fertilizer composition (e.g., a chloride-containing fertilizer composition). The treatment compositions disclosed herein can be applied alone or with other reagents, e.g., with other fertilizers, pesticides, herbicides, and the like.

In particularly preferred embodiments, tobacco is treated with at least two different treatment compositions and/or at at least two different stages pre-cure. Multiple treatments can be done sequentially (e.g., in close succession or at significantly different time points) or simultaneously (e.g., by separately applying two or more different compositions to the tobacco or by mixing the compositions to provide a single treatment composition comprising two or more different active ingredients and applying the single treatment composition to the tobacco). Where compositions are applied at at least two different stages, they can be applied at different points of the tobacco plant life cycle (e.g., with one applied to growing plants in the field and one applied following harvest or with one applied to seeds and one applied to growing plants in the field). Multiple treatments can comprise treating a plant at at least two different stages with the same treatment composition or different treatment compositions. In one particular embodiment, tobacco is treated at least once pre-cure with a salt-containing composition and at least once pre-cure with a lactic acid bacteria-containing composition. Further details regarding timing and methods of application are provided in US Pat. Appl. Pub. No. 2014/0299136 to Moldoveanu et al., which is incorporated herein by reference.

Treatment with a treatment composition at this stage can advantageously provide various benefits. Particularly, it is known that tobacco plants naturally have various levels of bacteria associated therewith (see, for example, Larsson L. et al., *Tobacco Induced Diseases,* 4:4 (2008) and Huang J. et al., *Appl. Microbiol. Biotechnol.* 88(2): 553 (2010), which are incorporated herein by reference); and the use of a pre-cure treatment composition as described herein can provide tobacco plants, plant components, and plant materials with modified levels of certain bacteria associated therewith. In some embodiments, the treatment of an uncured or partially cured plant, plant component, or plant material as described herein results in a treated tobacco plant material having a modified total bacteria count, a modified enteric bacteria count, a modified gram-negative bacteria count, and/or a modified *Lactobacillus* count. The modified counts achievable and methods for determining such counts are disclosed in US Pat. App. Publ. No. 2014/0299136 to Moldoveanu et al., which is incorporated herein by reference.

Different treatments can have different effects on the levels of various bacteria present within the tobacco plant material. As noted above, the treatment described herein may affect the properties of the treated tobacco and may be particularly beneficial to modify the content of certain bacteria prior to curing (including fermenting) the treated tobacco. The pre-cure treatment disclosed herein can, in some embodiments, have further implications for later processing steps. For example, the treatments can provide various benefits to later steps of curing, aging, and/or fermenting the tobacco material.

Where the pre-cure treatment is conducted while the tobacco plant or portion thereof is in living form, tobacco is generally harvested (if not already harvested prior to pre-cure treatment) and subjected to curing. Traditional techniques of harvesting tobacco plants can be employed as set forth, for example, in US Pat. Appl. Pub. Nos. 2011/0174323 to Coleman, III et al. and 2012/0192880 to Dube et al., which are incorporated by reference herein. It is particularly preferred that harvested tobaccos that are grown, harvested and processed in accordance with the present invention be subjected to curing processes that can be characterized as providing so-called air cured or dark-fired tobaccos. See, for example, those types of curing processes set forth in *Tobacco Production, Chemistry and Technology*, Davis et al. (Eds.) (1999); Roton et al., *Beitrage Tabakforsch Int.,* 21, 305-320 (2005); Staaf et al., *Beitrage Tabakforsch Int.,* 21, 321-330 (2005) and U.S. Pat. Nos. 1,327,692 to Beinhart; 2,758,603 to Heljo; 5,676,164 to Martin; 6,755,200 to Hempfling et al.; 7,293,564 to Perfetti et al.; 7,650,892 to Groves et al.; 8,353,300 to Li et al.; and US Pat. Appl. Pub. Nos. 2010/0116281 and 2012/0279510 to Marshall et al., and 2014/0299136 to Moldoveanu et al., which are all incorporated herein by reference.

In some embodiments, cured and/or aged tobaccos treated pre-cure with a treatment composition as disclosed herein can provide a tobacco material having modified levels of certain compounds, e.g., tobacco-specific nitrosamines (TSNAs), as compared with untreated cured/aged tobacco materials. Further information regarding the types of amounts of TSNA reductions achievable through such methods are provided in US Pat. App. Publ. No. 2014/0299136 to Moldoveanu et al., which is incorporated herein by reference.

In certain embodiments (e.g., where tobacco material is being prepared for use in certain smokeless tobacco products), cured tobacco material (optionally treated via treatment with a treatment composition pre-cure as disclosed in detail above) is then fermented. Fermentation generally requires subjecting the tobacco material to water (e.g., humidity) and heat. The fermentation process can be conducted in a chamber where the temperature and moisture content can be controlled. As a consequence of the elevated temperature and moisture content to which the tobacco is exposed during the fermentation process, certain components (e.g., ammonia) may be effectively removed from the tobacco. In some embodiments, fermentation is a bacterial process, wherein certain bacteria produce enzymes that react to produce flavor precursors within the fermenting tobacco material. See, e.g., S. Gilliland, Ed., Bacterial Starter Cultures for Foods, CRC Press, Inc. (Boca Raton, Fla.), at pg. 97-118, which is incorporated herein by reference.

Exemplary fermentation processes for tobacco are provided in U.S. Pat. Nos. 2,927,188 to Brenik et al.; 4,660,577 to Sensabaugh et al.; 4,528,993 to Sensabaugh et al.; and 5,327,149 to Roth et al., which are incorporated herein by reference. Fermentation is understood to be enhanced by the presence of, e.g., *Lactobacillus*; consequently, modification of the amount of *Lactobacillus* bacteria associated with a given sample (e.g., by means of a lactic acid bacteria treatment composition as disclosed above) can, in some embodiments, impact the fermentation of that sample. Where that treated tobacco is later subjected to fermentation, the fermentation can, in some embodiments, be enhanced by the presence of a greater number of *Lactobacillus* bacteria. By "enhanced" is meant that the fermentation process proceeds, for example, more quickly, and/or more uniformly. Accordingly, the methods disclosed herein for the treatment of uncured or partially cured tobacco plants, plant components, or plant material with a treatment composition can impact the fermentation process to some extent by modifying the bacteria type and/or count on the fermenting tobacco as compared with that on untreated fermenting tobacco.

In certain embodiments of the present disclosure, the bacteria type and/or count on the tobacco during fermentation can be further modified by treating the tobacco with one or more microorganisms (e.g., bacteria, yeast, fungi, etc.) just prior to or during fermentation. The tobacco being treated in this manner just prior to or during fermentation can advantageously be tobacco that has been previously treated with one or more treatment compositions as described herein (i.e., comprising salt, sugar, lactic acid bacteria, yeast and/or enzymes). However, the tobacco that can be treated just prior to or during fermentation as described herein is not limited; in other embodiments, the tobacco being treated during or just prior to fermentation can be tobacco that has not been previously treated with a treatment composition as described above.

Treatment with one or more microorganisms in this context generally comprises applying one or more microorganisms to a tobacco material to modify the amount and/or type of microorganisms (e.g., bacteria, yeast, fungi, etc.) associated with the fermenting tobacco. The types of microorganisms employed in such treatment steps can vary, but are preferably microorganisms capable of facilitating the fermentation reaction but exhibiting little to no affinity for nitrates. It is known that certain microorganisms (e.g., particular bacteria strains or particular fungi) are particularly capable of facilitating the conversion of nitrates to nitrites (typically by the production of a nitrate-reducing enzyme, although not limited thereto). It is further recognized that the conversion of nitrates to nitrites, facilitated by such bacteria during fermentation of tobacco, generates precursors that can lead to the formation of certain TSNAs in fermented tobacco material. According to the present disclosure, this conversion of nitrates to nitrites is advantageously minimized (e.g., partially or wholly eliminated) during the fermentation process.

As such, advantageously, in some embodiments, the treatment of tobacco with one or more microorganisms just prior to or during fermentation can provide tobacco exhibiting modified (e.g., decreased) levels of TSNAs following fermentation. In particular, decreased levels of TSNAs can be achieved by treating the tobacco just prior to or during fermentation with one or more particular types of microorganisms, which will be described more fully herein.

Advantageously, microorganisms (e.g., bacteria, yeast, and/or fungi) which do not substantially facilitate the conversion of nitrate to nitrite (i.e., have little to no affinity for nitrates); microorganisms that can act as "nitrite sinks;" and/or microorganisms that have a nitrite reductase gene are used according to the presently disclosed methods. Accordingly, in certain embodiments, microorganisms particularly useful according to the present disclosure during the fermentation step provide for a decreased nitrite concentration in the fermented material as compared to typical (non-fermentation-treated material). Such added microorganisms can be native to the tobacco material or non-native to the tobacco material. Typically, the microorganisms added to the tobacco material at this stage are added in exogenous amounts, i.e., they are added so as to provide modified, i.e., increased levels of such microorganisms as compared to the levels typically present on untreated tobacco.

The types of microorganisms contemplated by the present disclosure include microorganisms that are capable of growth competition with one or more nitrate-reducing microorganisms that are associated with the tobacco. See Fisher et al., Food and Chem. Tox. 50(3-4), 2012, pp. 942-948, which is incorporated herein by reference. The association of nitrate-reducing microorganisms with the tobacco can, in some embodiments, be the result of resident populations of microorganisms on the tobacco (i.e., native microorganisms), may be the result of processing conditions (e.g., where microorganisms are introduced into the tobacco material by contact with equipment having such microorganisms present thereon) or may be the result of previous treatment steps (e.g., where the tobacco has been treated pre-cure with a treatment composition comprising lactic acid bacteria). Exemplary nitrate-reducing microorganisms that are native to certain types of tobacco that are effectively minimized in certain embodiments include, but are not limited to, bacteria of the *Enterobacter* and/or *Pantoea* genus.

Exemplary microorganisms that can be added to tobacco during fermentation can include, but are not limited to, bacteria belonging to the *Flavimonas* genus (e.g., *Flavomonas oryzihabitans*), as described in U.S. Pat. No. 7,549,425 to Koga; *Sphingomonas paucimobills* or *Pseudomonas fluorescens*, as described in WO 2003/094639 to Koga, *bacillus pumilis*, yeast (e.g., yeast strain *Debaryomyces hansenii* TOB-Y7, as disclosed in Vigliotta et al., Appl. Microbiol. Biotechnol. 2007, 75:633-645), and nitrite reductase gene-containing microorganisms including, but not limited to, microorganisms of the bacterial genera *Pseudomonas, Bordatella, Alcaligenes*, and *Achromobacter*. See, e.g., Yoshie et al., Appl. Environ. Microbiol. 70(5): 3152-3157 (2004), Song et al., FEMS Microbiology Ecology 43: 349-357 (2003), and Takahashi et al., Plant Physiology 126(2): 731-741 (2001). Another exemplary microorganism that can be added during fermentation is *Tetragenococcus halophilus*. The foregoing documents describing various microorganisms are hereby incorporated by reference herein in their entireties. In some embodiments, microphages (e.g., bacteriophages) can be employed to decrease the amount of bacteria associated with the tobacco material, such as set forth in US Pat. Appl. Pub. 2014/0261478 to Xu et al., which is incorporated herein by reference.

In certain embodiments, the microorganism may be a genetically modified microorganism, e.g., including but not limited to, a genetically modified *Tetragenococcus* bacteria. The genetic modification can, for example, comprise insertion of the gene encoding for the nitrite reductase enzyme into the DNA of the microorganism. Accordingly, in some embodiments, microorganisms (e.g., bacteria) are used in the methods disclosed herein, wherein the microorganisms have been genetically modified to render them capable of producing nitrite reductase enzymes (including, in certain embodiments, *Tetragenococcus* bacteria modified to include a nitrite reductase gene).

It is noted that although these microorganisms are described in the context of fermentation (i.e., applied just prior to or during to fermentation), this timing is not intended to be limiting. For example, it may be, in some embodiments, be advantageous to apply such microorganisms at other stages of tobacco treatment (e.g., just prior to harvest, during the early stages of curing, during curing, immediately following curing, and/or during preparation of the tobacco material for storage).

In some embodiments, the type or types of microorganisms advantageously selected for use in this treatment step is affected by the type of pre-cure treatment composition (if any) employed. For example, where tobacco is treated pre-cure with a salt (e.g., a chloride salt), it may be important to select microorganisms that function well in such salt conditions.

Generally, the amount of the microorganisms added, the particular strain (or combination of strains) of the particular microorganism can vary (e.g., various strains of *Tetragenococcus*, alone, or in a mixture of two or more strains can be employed), the processing methods can vary, and other ingredients added to the fermenting mixture can also vary. Advantageously, such parameters can be modified as desired to decrease the presence of nitrite, minimize the production of tobacco-specific nitrosamines, and influence the flavor characteristics of the tobacco material.

The microorganisms added just prior to or during the fermentation step are typically added in an amount sufficient to facilitate the fermentation process. See generally the discussion of bacteria-facilitated fermentation set forth in S. Gilliland, Ed., Bacterial Starter Cultures for Foods, CRC Press, Inc. (Boca Raton, Fla.), at pg. 97-118, which is incorporated herein by reference. According to the present disclosure, the microorganisms can advantageously in some embodiments be added in an amount sufficient to compete, at least to some extent, with native microorganisms present in or on the tobacco to which they are applied. Typical amounts of microorganisms to be added are in an amount of at least about $1\times10^3$ CFU (e.g., between about $1\times10^3$ CFU and about $1\times10^{10}$ CFU, such as between about $1\times10^3$ CFU and about $1\times10^9$ CFU or between about $1\times10^3$ CFU and about $1\times10^8$ CFU. In some embodiments, providing the microorganism(s) at a higher concentration can significantly increase the rate of fermentation; however, in some embodiments, little increase is observed. In some embodiments, the microorganism is phage resistant and rotation of multiple species may be employed during the fermentation process. Advantageously, endogenous bacteria, yeast, and/or fungi associated with tobacco in certain embodiments remain relatively constant and can be killed by heat and/or competitively suppressed by a phage during fermentation. In certain embodiments, such endogenous microorganisms may be selected against using appropriate treatment conditions (e.g., pH and/or salt concentration levels at which the endogenous microorganisms are not competitive).

The method of adding the microorganisms just prior to or during fermentation can also vary. For example, in some embodiments, the tobacco material can be sprayed with a solution or suspension of the microorganism (e.g., in water) or the tobacco material can be contacted with a powder containing the microorganism.

The specific conditions under which fermentation is conducted can vary and, in some embodiments, the selection of such conditions can influence the properties of the fermented tobacco product. For example, in certain embodiments, the specific conditions (e.g., temperature, time, moisture level, oxygen level, pH, aeration time, other additives) can affect the amount of TSNA produced. As such, these conditions are advantageously selected so as to minimize the amount of TSNA produced. Appropriate conditions for fermentation are also determined, at least in part, based on the specific microorganism(s) used. for example, it is known that microorganisms perform differently at different conditions. For example, some microorganisms perform better than others at certain pH values, salt concentrations, and temperatures. Accordingly, the selection of a particular microorganism may limit the conditions under which the fermentation can be conducted in certain embodiments. It is noted that conditions can, in some embodiments, be adjusted to provide appropriate conditions for a given microorganism or microorganisms. For example, where the pH of the tobacco material is low and a microorganism is known to function well only at higher pH values, the pH of the tobacco material can be adjusted (e.g., through the addition of a base). Methods for modifying fermentation conditions are known as described, for example, in U.S. Pat. No. 7,946,295 to Brinkley et al., which is incorporated herein by reference. Fermentation can be conducted such that partial or complete fermentation of the tobacco material is achieved. For example, in certain embodiments, the fermentation process can be monitored (e.g., by monitoring malic acid conversion) and the tobacco can be further processed at a given percentage of malic acid conversion.

In certain embodiments, tobacco is treated and fermented according to the specific process detailed below. A tobacco material is received and can optionally be stored at a given moisture level (e.g., at about 13-18% moisture) for a given period of time, such as at least about a year, e.g., between about 1 and about 3 years. The tobacco material is generally treated with moisture to bring the moisture level of the tobacco material within a given range of moisture (e.g., at least about 15%, at least about 20%, between about 15% and about 30%, or between about 20% and about 25%, such as about 22% moisture in one embodiment) at a given temperature (e.g., at a temperature of about 100° F. or greater, a temperature of about 110° F. or greater, a temperature of about 120° F. or greater, or a temperature of about 130° F. or greater, such as within the range of about 120° F. to about 150° F., or about 130° F. to about 150° F., such as about 140° F. in one embodiment). It is noted that particularly beneficial values can depend on the type of tobacco being treated and thus, these values can be adjusted accordingly.

Although not intended to be limiting, in particular embodiments, the tobacco can be conditioned on a direct cylinder conditioning unit. Following conditioning, the conditioned tobacco is generally separated into parts (e.g., stems are removed from the remaining portion of tobacco material). This separation can be accomplished, e.g., using a threshing mill with air separation. Exemplary equipment that can be employed for this purpose can be provided, for example, by Cardwell Machine Company (Richmond, Va.) or MacTavish Machine Manufacturing Company (Chesterfield, Va.). The separated tobacco material, preferably with stems removed therefrom, can be directly subjected to fermentation or can, in some embodiments, be conveyed, e.g., into pre-blending silos. Typically, different types of tobacco are separately processed and each type is conveyed to a different pre-blending silo.

For some applications, it may be desirable to combine two or more types of tobacco. Accordingly, in some embodiments, tobaccos can be combined from two or more sources (e.g., two or more pre-blending silos) in the desired ratio. For example, tobacco from the pre-blending silos can, in certain embodiments, be conveyed by weigh belt from the pre-blending silos to be combined (e.g., in a blending bulker). In some embodiments, the tobacco material (a single type of tobacco or a blended form as disclosed herein) can then be doffed and cut to provide tobacco material strands of desired length and width. Such lengths and widths can vary, e.g., the lengths and widths typically designated as "fine cut," "long cut," and the like.

This cut tobacco is subjected to fermentation, e.g., as generally described herein. In some embodiments, the fermentation can advantageously be conducted within a solid state fermentation (SSF) vessel, such as a mixer, e.g., a Plow Mixer (e.g., from Littleford Day, Inc. (Florence, Ky.)). Within the fermentation vessel, parameters including moisture level, salinity, and temperature can beneficially be modified. For example, in some embodiments, the moisture level of the tobacco is initially modified to ensure a moisture level of at least about 10%, at least about 20%, or at least about 30%, such as between about 20% and about 50% or between about 30% and about 45%. In some embodiments, the salinity of the tobacco is initially modified to ensure a salinity of at least about 1%, such as between about 1% and about 6% on a dry weight basis.

The temperature within the vessel is typically increased to a first elevated temperature, to cause sporulation of at least a portion of any dormant spore forming bacteria (i.e. *Bacillus* sp.) associated with the tobacco material. This first elevated temperature can vary, but is generally at least about 80° F. or at least about 85° F., such as within the range of about 85° F. to about 105° F. This first elevated temperature is maintained for a sufficient time period to allow sporulation to occur (e.g., at least about 5 minutes, at least about 10 minutes, at least about 15 minutes, or at least about 30 minutes, such as between about 5 and about 60 minutes). In some embodiments, the temperature is then further increased to a second elevated temperature, to heat kill vegetative bacteria. This second elevated temperature can vary, but is generally at least about 150° F. or at least about 160° F., such as within the range of about 160° F. to about 212° F. This temperature is maintained for a sufficient time period to provide a reduction in the number of living vegetative bacteria (e.g., at least about 5 minutes, at least about 10 minutes, at least about 15 minutes, or at least about 30 minutes). However, in certain embodiments, this time period is advantageously controlled so as to ensure that no substantial tobacco-specific nitrosamine formation occurs. For example, this time period can, in some embodiments, be between about 5 and about 60 minutes.

The tobacco material is subsequently cooled, e.g., to about 100° F. or less, such as between about 85° F. and about 100° F. The bacterial knockdown achieved by these heating process steps can vary. In some embodiments, treatment of a tobacco material in this manner can provide the desired bacterial knockdown level. In other embodiments, one cycle of these heating process steps is insufficient to achieve the desired bacterial knockdown. Accordingly, one or both of these heating process steps can be, in some embodiments repeated independently or in combination two or more times as required to achieve the desired bacterial knockdown. The desired bacterial knockdown is generally that amount sufficient to substantially prevent TSNA formation during the fermentation process. The specific value required to achieve this goal can depend on a variety of factors, such as pH, inoculation rate, water activity, etc. In some embodiments, a knockdown of >log 1, >log 2, >log 3, or >log 5 may be desirable. In some embodiments, a residual endogenous bacterial level of <log 1 is required.

The tobacco material, having a reduced bacterial level, is then treated with one or more microorganisms as disclosed herein. In one embodiment, the tobacco material is first treated with a buffer solution to provide a tobacco material with a particular pH. In some embodiments, the pH is advantageously between about 7 and about 8 (e.g., about 7.4). The buffer can vary, and in some embodiments, can comprise an aqueous solution of potassium carbonate, sodium carbonate, ammonium carbonate, or a combination thereof. In certain embodiments, such a buffer solution can be prepared in a mixing tank that is coupled to the vessel in which the tobacco material is held. The buffer solution can then be applied to the tobacco material through a pumping system. Other methods for application of a buffer solution to a tobacco material are known and are intended to be encompassed herein as well. Preferably, the buffer is thoroughly mixed with the tobacco material, e.g., by employing a mixer to ensure proper and even mixing between the tobacco material and the buffer.

One or more microorganisms as disclosed herein is then applied to the buffered material. The microorganism can be applied, for example, in solution form and can be applied in a similar manner as the buffer solution. Relevant microorganisms include those referenced above, including, but not limited to, non-nitrate reducing bacteria and/or yeast, e.g., *Tetragenococcus halophilus*. The inoculation rate can vary, but representative inoculation rates are between about $10^3$ CFU and about $10^9$ CFU. Following the introduction of microorganisms and during the following fermentation process, the moisture of the tobacco material throughout the fermentation can, in some embodiments, be adjusted. The moisture of the fermenting tobacco is advantageously maintained within the range of about 35% moisture to about 50% moisture, and ideally within the range of about 40% to about 45% throughout the fermentation.

Similarly, the temperature of the fermenting tobacco is advantageously controlled (e.g., maintained) throughout the fermentation process. Exemplary temperatures at which the tobacco material is maintained are within the range of about 80° F. to about 95° F. Methods for controlling the temperature are generally known. In some embodiments, the temperature can be controlled by a heating/cooling jacket associated with a SSF vessel in which the fermentation is conducted. The oxygen level of the fermenting tobacco is also beneficially controlled throughout fermentation. Methods are known for the control of oxygen content within a vessel and include, but are not limited to, employing high efficiency particulate arrestance (HEPA) filters through which air can pass into the vessel, and/or by stirring or otherwise moving the tobacco material during fermentation (e.g., by rotating tines in a mixing vessel, such as 1 or more times a week, e.g., about 1 to about 3 times per week).

The time for which the tobacco material is maintained under these conditions can vary. Typically, the tobacco material is maintained under these conditions until a desirable level of fermentation is achieved. In some embodiments, fermentation can be monitored by evaluating the level of, e.g., malic and citric acid, which are depleted during fermentation. Although not intended to be limiting, exemplary fermentation times can be at least about 2 weeks or at least about 3 weeks, e.g., about 3 to about 4 weeks. These values can vary, e.g., depending on such parameters as inoculation rate, moisture, temperature, pH, salinity, and aeration. The final pH following a successful fermentation should be approximately 7.6-7.9.

When the fermentation is completed to the desired extent, the fermented tobacco material is typically treated with heat. This heat treatment can, in some embodiments, be sufficient to stop the fermentation and heat kill any active, vegetative microbes. This post-fermentation heat treatment can be achieved, for example, in a manner similar to that described above with respect to heat treatment prior to fermentation. In some embodiments, various components can then be added to the heat treated fermented tobacco material. For example, preservatives, casings, moisture, and salinity can be adjusted through addition of the appropriate components to the heat treated fermented tobacco material (e.g., by adding such components directly to the fermentation vessel). Alternatively, in some embodiments certain components can be added prior to fermentation when it is advantageously to adjust the pool of reagents prior to fermentation. In certain embodiments, following the method disclosed above, the heat treated tobacco material can be dried (e.g., to a moisture level of between about 15% and about 20%, e.g., about 18% moisture) for storage and shipping. Such heat treated tobacco material can be subsequently processed, e.g., by adjusting the final salinity, preservative, casing and moisture content.

The types of treatment described herein can be performed independently or the treatments described herein can be performed in combination. For example, the pre-cure treatment methods described herein can be employed once, twice, three times or more prior to the end of the curing process. Such treatments can employ the same or different treatment compositions. In some embodiments, tobacco materials are treated with both a salt and one or more lactic acid bacteria prior to the completion of curing. Similarly, the fermentation treatment disclosed herein can be conducted once or multiple times during the fermentation process (i.e., by adding one or more types of microorganisms to the tobacco material once or multiple times during fermentation). Where the microorganisms are added multiple times during fermentation, the type(s) of microorganisms added can be the same or different.

In one particular embodiment, a tobacco plant is treated with a salt (e.g., NaCl or KCl) prior to harvest, followed by treatment with one or more lactic acid bacteria or salt-tolerant yeast pre-cure (e.g., during the early stages of curing), followed by treatment with one or more microorganisms during fermentation. In certain embodiments, pre-cure salt treatment can result in the presence of chloride in the tobacco material throughout the curing and fermentation processes and, in some embodiments, the chloride is believed to slow the undesirable reduction of nitrate during fermentation and/or slow the formation of undesirable TSNAs.

Treatment of tobacco in the manner described herein can provide a treated tobacco material with, in some embodiments, comparable levels of TSNA as compared with the initial tobacco material (e.g., the as-harvested material). Advantageously, the tobacco can be treated as disclosed herein and fermented to provide a fermented tobacco material having a TSNA level that is no more than the TSNA level of the tobacco material subjected to fermentation. In other words, in certain embodiments, the fermentation process is controlled as disclosed herein so as to ensure that little TSNA (including substantially no TSNA and no TSNA) is formed during the fermentation process. In some embodiments, the tobacco can be treated and fermented to provide a fermented tobacco material having a TSNA level that is no more than the TSNA level of the as-harvested tobacco.

In some embodiment, one or more steps as disclosed herein can lead to decreased levels of TSNAs as compared with untreated tobacco (including significantly decreased levels of TSNAs). For example, in certain embodiments, the amount of TSNA in tobacco treated as described herein can be about 75% or less that amount typically contained in (non-treated) fermented tobacco, about 50% or less, about 25% or less, about 10% or less, about 5% or less, about 2% or less, or about 1% or less. For example, in certain embodiments, the amount of TSNA in the fermented tobacco material can be about 20 μg or less, about 15 μg or less, about 12 μg or less, or about 10 μg or less. Desirably, the amount of TSNA in the tobacco prior to fermentation is minimal (e.g., falling within the ranges noted above) and the amount of TSNA in the tobacco following fermentation is not significantly higher (e.g., the amount of TSNA in the fermented tobacco is equal to or less than the amount of TSNA in the tobacco just prior to fermentation).

In some embodiments, the treatment methods described herein can provide a treated tobacco material with higher salt (including, in some embodiments, higher chloride) content. Advantageously, the chloride content of tobacco material treated as described herein is between 0% and about 4%, e.g., between about 0.1% and about 3%, or between about 0.5% and about 3% by weight, on a dry weight basis. In certain preferred embodiments, the chloride content of tobacco material treated as described herein is less than about 4%, less than about 3%, or less than about 2% by weight. Although increased salt/chloride content can, in certain applications, be detrimental, in some embodiments, the presence of increased salt/chloride can be non-detrimental and, in certain embodiments, desirable. For example, such treated materials may be less desirable for use in smoking articles, wherein combustion of the tobacco material occurs. Increased salt/chloride content can, in some embodiments, be more acceptable and/or desirable in applications wherein the tobacco material is not combusted (e.g., in smokeless tobacco products and/or in electronic smoking articles), as will be described more full below.

It is noted that other benefits may arise the types of treatment described herein. For example, in certain embodiments, modified flavor and/or aroma profiles can be obtained at various stages of fermentation in the presence of microorganisms as compared with the profiles of tobacco undergoing fermentation in the absence of microorganism treatment.

The treated tobacco materials provided according to the present disclosure can be further processed and used in ways generally known in the art. See, for example, U.S. Patent Appl. Publ. Nos. 2012/0272976 to Byrd et al. and 2014/0299136 to Moldoveanu et al., which are incorporated herein by reference. In various embodiments, the treated tobacco can be employed in smoking articles, smokeless tobacco products, and electronic smoking articles. Certain treated tobacco materials described herein can find use, for example, in products wherein salt and/or chloride content does not negatively impact the properties of the product, wherein TSNA content is advantageously minimized, and/or wherein fermented materials are beneficially employed.

Of particular interest are smokeless tobacco products comprising tobacco materials treated as described herein, the makeup of which can vary. See, for example, those representative components, combination of components, relative amounts of those components and ingredients relative to tobacco, and manners and methods for employing those components, set forth in U.S. Pat. No. 8,061,362 to Mua et al. and U.S. Pat. Pub. Nos. 2007/0062549 to Holton, Jr. et al.; 2007/0186941 to Holton, Jr. et al.; and 2008/0029110 to Dube et al., each of which is incorporated herein by reference.

In certain embodiments, snus or snuff-type products (e.g., ground tobacco materials incorporated within sealed pouches) comprising the types of treated tobacco materials disclosed herein, e.g., including, but not limited to, treated fermented tobacco materials (alone or in combination with other types of tobacco materials) are provided. Exemplary embodiments of such snus products are illustrated and described, for example, in US Pat. App. Publ. No. 20120279510 to Marshall et al., which is incorporated herein by reference. Descriptions of various components of snus products and components thereof also are set forth in U.S. Pat. Pub. No. 2004/0118422 to Lundin et al., which is incorporated herein by reference. See, also, for example, U.S. Pat. Nos. 4,607,479 to Linden; 4,631,899 to Nielsen; 5,346,734 to Wydick et al.; and 6,162,516 to Derr; and U.S. Pat. Pub. Nos. 2005/0061339 to Hansson et al. and 2010/0018539 to Brinkley et al., each of which is incorporated herein by reference.

It is noted that although the discussion provided herein focuses in large part on treatment of tobacco, a variety of other plants (including fruits, vegetables, flowers, and components thereof) can be treated according to the methods provided herein to afford plants, plant components, and materials and products produced therefrom having modified levels of certain compounds associated therewith.

EXPERIMENTAL

The present invention is more fully illustrated by the following examples, which are set forth to illustrate the present invention and are not to be construed as limiting thereof. Unless otherwise noted, all parts and percentages are by weight, and all weight percentages are expressed on a dry basis, meaning excluding water content, unless otherwise indicated.

Example 1

Treatment of Pre-Cured Tobacco with Treatment Solution

Dark-air cured tobacco is treated five hours prior to harvest with one or more of a probiotic bacteria solution, an enzyme solution, and/or a 3% sodium chloride salt solution. The solution is applied using a backpack sprayer. Solutions are based on a 100 gallon solution per acre, using recommended plant spacings and dose per plant is provided below. The treated tobacco is harvested and mid-stalk leaf samples are analyzed for total bacteria counts, enteric bacteria counts, and *Lactobacillus* counts. Ten grams of each treated tobacco sample is placed in Butterfields Phosphate Buffer and diluted $10^{-2}$ to $10^{-8}$ times with water. The treated tobacco sample dilutions are applied to plate count agar (PCA) for total aerobic bacteria counts, to violet red bile agar (VRBA) for gram negative bacteria counts, and to MRS for anaerobic (*Lactobacillus*) counts. The number of bacterial colonies, as visualized under magnification, are counted to estimate the total number of colony-forming units per gram, CFU/g.

Tobacco treated with a probiotic solution available from CVS (solution prepared to provide $6.00\times10^9$ CFU per plant) exhibited a total bacteria reduction after treatment of 91%, an enteric bacteria reduction after treatment of 40%, and a *Lactobacillus* reduction after treatment of 46% (all based on total bacteria counts before and after treatment).

Tobacco treated with a probiotic solution available from Walgreens (solution prepared to provide $6.40\times10^9$ CFU per plant) exhibited a total bacteria reduction after treatment of 96%, an enteric bacteria reduction after treatment of 58%, and a *Lactobacillus* reduction after treatment of 42% (all based on total bacteria counts before and after treatment).

Tobacco treated with a probiotic solution available from CVS (solution prepared to provide $6.00\times10^9$ CFU per plant) in combination with a surfactant (Surf-Ac® from Drexel Chemical Company) exhibited a total bacteria reduction after treatment of 95%, an enteric bacteria reduction after treatment of 66%, and a *Lactobacillus* increase after treatment of 57% (all based on total bacteria counts before and after treatment).

Tobacco treated with a *Lactobacillus plantarum* probiotic solution (solution prepared to provide $6.64\times10^{10}$ CFU per plant) exhibited a total bacteria reduction after treatment of 95%, an enteric bacteria reduction after treatment of 75%, and a *Lactobacillus* increase after treatment of 43% (all based on total bacteria counts before and after treatment).

Tobacco treated with a *Lactobacillus acidophilus* probiotic solution (solution prepared to provide $2.72\times10^{10}$ CFU per plant) exhibited a total bacteria reduction after treatment of 93%, an enteric bacteria reduction after treatment of 20%, and a *Lactobacillus* reduction after treatment of 33% (all based on total bacteria counts before and after treatment).

Tobacco treated with a *Bifidobacterium lactis* probiotic solution (solution prepared to provide $4.16\times10^{10}$ CFU per plant) exhibited a total bacteria reduction after treatment of 82%, an enteric bacteria reduction after treatment of 25%, and a *Lactobacillus* reduction after treatment of 16% (all based on total bacteria counts before and after treatment).

Tobacco treated with a *Lactobacillus helveticus* probiotic solution (solution prepared to provide $5.20\times10^9$ CFU per plant) exhibited a total bacteria reduction after treatment of 97%, an enteric bacteria reduction after treatment of 39%, and a *Lactobacillus* increase after treatment of greater than 400% (all based on total bacteria counts before and after treatment).

Tobacco treated with a PreventASe™ enzyme solution (solution prepared to provide 3.2 mL asparaginase per plant) exhibited a total bacteria reduction after treatment of 88%, an enteric bacteria reduction after treatment of 75%, and a *Lactobacillus* reduction after treatment of 43% (all based on total bacteria counts before and after treatment).

Tobacco treated with a 3% NaCl solution exhibited a total bacteria reduction after treatment of 94%, an enteric bacteria reduction after treatment of 76%, and a *Lactobacillus* increase after treatment of greater than 400% (all based on total bacteria counts before and after treatment).

The data illustrates that all treatment solutions provided in a decrease in total bacteria associated with the treated tobacco material (as compared with the tobacco material prior to treatment). The salt (NaCl)-treated tobacco material exhibited a significant increase in desirable *Lactobacillus* bacteria. This finding may render such NaCl (and other salt)-treated tobacco materials particularly suitable for further fermentation processes and for incorporation of such fermented tobacco materials into smokeless tobacco products. Additionally, the *Lactobacillus helveticus*-treated tobacco material exhibited a substantial increase in *Lactobacillus* bacteria after treatment. Although some increase might be expected due to the presence of *Lactobacillus* bacteria in the treatment solution, the increase is much higher than that noted for other *Lactobacillus* probiotic solution-treated tobacco materials (e.g., tobacco treated with *Lactobacillus plantarum* exhibited only a 43% increase and tobacco treated with *Lactobacillus acidophilus* exhibited a 33% decrease in *Lactobacillus* bacteria). Consequently, *Lactobacillus helveticus*-treated tobacco materials may be particularly well suited for further fermentation processes and incorporation of such fermented tobacco materials into smokeless tobacco products as well.

Example 2

Treatment of Tobacco with Microorganism

Tobacco (e.g., tobacco treated by any of the methods presented above in Example 1) is subjected to fermentation by moistening the tobacco (e.g., by subjecting the tobacco to humid conditions). Control of endogenous bacteria, yeast, and fungi are controlled during the fermentation process by selecting and maintaining appropriate water activity, pH, salinity, and temperature conditions to provide appropriate conditions for the starter culture or desired endogenous microorganism(s) to ferment the tobacco and prevent TSNA precursor formation. A solution of bacteria (e.g., *Tetragenococcus halophilus*) alone, or in combination with yeast, is applied to the fermenting tobacco and the tobacco is fermented under such conditions for a period of about 1 to 6 weeks. A decreased TSNA content in the tobacco relative to fermented tobacco treated as in Example 1 but without treatment with *Tetragenococcus halophilus* during fermentation is observed.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method of modifying the tobacco-specific nitrosamine content of a tobacco material, comprising:

fermenting cured tobacco material in the presence of one or more microorganisms, wherein the one or more microorganisms are present in exogenous amounts to the cured tobacco material to provide a fermented tobacco material having a tobacco-specific nitrosamine content that is reduced relative to a fermented tobacco material that has not been fermented in the presence of said microorganisms, wherein the one or more microorganisms comprise *Tetragenococcus halophilus*.

2. The method of claim 1, wherein the tobacco material is selected from the group consisting of a tobacco seed, a tobacco seedling, an immature live plant, a mature live plant, or a portion thereof.

3. The method of claim 1, wherein the tobacco material comprises tobacco selected from the group consisting of Black Mammoth, Greenwood, Little Wood, Improved Madole, TR Madole, Little Crittendon, DF 911, KY 160, KY 171, KY 180, KY 190, KY 309, KY VA 312, VA 355, VA 359, DF 485, TN D94, TN D950, and combinations thereof.

4. The method of claim 1, wherein the *Tetragenococcus halophilus* comprise genetically modified bacteria.

5. The method of claim 4, wherein the genetically modified bacteria comprise inserted genes encoding for nitrite reductase.

6. The method of claim 1, wherein the tobacco-specific nitrosamine is reduced by about 10% or more.

7. The method of claim 1, wherein the tobacco-specific nitrosamine is reduced by about 20% or more.

8. The method of claim 1, wherein the tobacco-specific nitrosamine content is reduced by about 50% or more.

9. The method of claim 1, wherein the tobacco-specific nitrosamine content of the fermented tobacco material is no more that the tobacco-specific nitrosamine content of the cured tobacco material.

10. The method of claim 1, wherein the chloride content of the fermented tobacco material is between about 0.5% by weight and about 3% by weight.

11. The method of claim 1, further comprising:

processing the fermented tobacco material to provide a processed tobacco material in a form suitable for incorporation in a tobacco product; and incorporating the processed tobacco material into a smokeless tobacco product.

12. The method of claim 11, wherein the processed tobacco material is in the form of a tobacco blend.

13. The method of claim 1, wherein the fermenting is conducted in a solid state fermentation vessel.

14. The method of claim 1, wherein the fermenting further comprises controlling temperature, moisture, oxygen level, or any combination thereof.

15. The method of claim 1, wherein the *Tetragenococcus halophilus* is present in an amount of about $10^6$ CFU.

16. The method of claim 1, further comprising subjecting the fermented tobacco material to elevated temperature.

17. The method of claim 1, further comprising adding one or more components to the fermented tobacco material, wherein the one or more components comprise components selected from the group consisting of salt, preservatives, casing mixtures, and moisture.

18. The method of claim 1, further comprising adjusting the moisture level of the fermented tobacco material.

* * * * *